US006434247B1

(12) United States Patent
Kates et al.

(10) Patent No.: US 6,434,247 B1
(45) **Date of Patent: *Aug. 13, 2002**

(54) FEEDBACK CANCELLATION APPARATUS AND METHODS UTILIZING ADAPTIVE REFERENCE FILTER MECHANISMS

(75) Inventors: James Mitchell Kates, Niwot; John Laurence Melanson, Boulder, both of CO (US)

(73) Assignee: GN ReSound A/S (DK)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/364,760

(22) Filed: Jul. 30, 1999

(51) Int. Cl.[7] ..... H04R 25/00

(52) U.S. Cl. ..... 381/312; 381/71.11

(58) Field of Search ..... 381/312, 318, 381/320, 321, 316, 317, 71.11, 71.12, 66, 93, 83, 23.1, FOR 129, FOR 131

(56) References Cited

U.S. PATENT DOCUMENTS 6,072,884 A * 6/2000 Kates ..... 381/318

FOREIGN PATENT DOCUMENTS

| | | |
|---|---|---|
| WO | 9926453 | 5/1999 |
| WO | 9951059 | 10/1999 |
| WO | 9960822 | 11/1999 |

OTHER PUBLICATIONS

Wyrsch, Sigisbert and August Kaelin. "A DSP Implementation of a Digital Hearing Aid with Recruitment of Loudness Compensation and Acoustic Echo Cancellation," Workshop on Applications of Signal Processing to Audio and Acoustics, 1997, 1–4.

Lindemann, Eric. "The Continuous Frequency Dynamic Range Compressor," IEEE Workshop on Applications of Signal Processing to Audio and Accoustics, New Paltz, NY, Oct. 19–22, 1997.

Czyzewski, A., R. Krolikowski, B. Kostek, H. Skarzynski, and A. Lorens. "A Method for Spectral Transposition of Speech Signal Applicable in Profound Hearing Loss," IEEE Workshop on Applications of Signal Processing to Audio and Accoustics, New Paltz, NY, Oct. 19–22, 1997.

Haykin, Simon, *Adaptive Filter Theory*, 3rd Ed., Prentice Hall, 1996, 170–171.

Kates, James M. "Feedback Cancellation in Hearing Aids: Results from a Computer Simulation," IEEE Transactions on Signal Processing 39(3), Mar. 1991, 553–562.

* cited by examiner

*Primary Examiner*—Sinh Tran
(74) *Attorney, Agent, or Firm*—Jennifer L. Bales; Macheledt Bales LLP

(57) ABSTRACT

A feedback cancellation system for a hearing aid or the like adapts a first filter in the feedback path that models the quickly varying portion of the hearing aid feedback path, and adapts a second filter in the feedback path that is used either as a reference filter for constrained adaptation or to model more slowly varying portions of the feedback path. The second filter is updated only when the hearing aid signals indicate that an accurate estimate of the feedback path can be obtained. Changes in the second filter are then monitored to detect changes in the hearing aid feedback path. The first filter is adaptively updated at least when the condition of the signal indicates that an accurate estimate of physical feedback cannot be made. It may be updated on a continuous or frequent basis.

20 Claims, 11 Drawing Sheets

FEEDBACK CANCELLATION APPARATUS AND METHODS UTILIZING ADAPTIVE REFERENCE FILTER MECHANISMS

BACKGROUND OF THE INVENTION

1. Field of the Invention

The present invention relates to apparatus and methods for feedback cancellation adapted to the detection of changes in the feedback path in audio systems such as hearing aids.

2. Prior Art

Mechanical and acoustic feedback limits the maximum gain that can be achieved in most hearing aids. System instability caused by feedback is sometimes audible as a continuous high frequency tone or whistle emanating from the hearing aid. Mechanical vibrations from the receiver in a high power hearing aid can be reduced by combining the outputs of two receivers mounted back to back so as to cancel the net mechanical moment; as much as 10 dB additional gain can be achieved before the onset of oscillation (or whistle) when this is done. But in most instruments, venting the BTE earmold or ITE shell establishes an acoustic feedback path that limits the maximum possible gain to less than 40 dB for a small vent and even less for large vents. The acoustic feedback path includes the effects of the hearing aid amplifier, receiver, and microphone as well as the vent acoustics.

The traditional procedure for increasing the stability of a hearing aid is to reduce the gain at high frequencies. Controlling feedback by modifying the system frequency response, however, means that the desired high frequency response of the instrument must be sacrificed in order to maintain stability. Phase shifters and notch filters have also been tried, but have not proven to be very effective.

A more effective technique is feedback cancellation, in which the feedback signal is estimated and subtracted from the microphone signal. Feedback cancellation typically uses an adaptive filter that models the dynamically changing feedback path within the hearing aid. Particularly effective feedback cancellation schemes are disclosed in patent application Ser. No. 08/972,265, entitled "Feedback Cancellation Apparatus and Methods," incorporated herein by reference and patent application Ser. No. 09/152,033 entitled "Feedback Cancellation Improvements," incorporated herein by reference (by the present inventors). Adaptive feedback cancellation systems, however, can generate a large mismatch between the feedback path and the adaptive filter modeling the feedback path when the input signal is narrow band or sinusoidal. Thus some adaptive feedback cancellation systems have combined an adaptive filter for feedback cancellation with a mechanism for reducing the hearing aid gain when a periodic input signal is detected (Wyrsch, S., and Kaelin, A., "A DSP implementation of a digital hearing aid with recruitment of loudness compensation and acoustic echo cancellation", Proc. 1997 IEEE Workshop on Applications of Signal Processing to Audio and Acoustics, New Paltz, N.Y., Oct. 19–22, 1997). This approach, however, may reduce the hearing aid gain even if the adaptive filter is behaving correctly, thus reducing the audibility of desired sounds.

A feedback cancellation system should satisfy several performance objectives: The system should respond quickly to a sinusoidal input signal so that "whistling" due to hearing aid instability is stopped as soon as it occurs. The system adaptation should be constrained so that steady state sinusoidal inputs are not canceled and audible processing artifacts and coloration effects are prevented from occurring. The system should be able to adapt to large changes in the feedback path that occur, for example, when a telephone handset is placed close to the aided ear. And the system should provide an indication when significant changes have occurred in the feedback path and are not just due to the characteristics of the input signal.

The preferred feedback cancellation system satisfies the above objectives. The system uses constrained adaptation to limit the amount of mismatch that can occur between the hearing aid feedback path and the adaptive filter being used to model it. The constrained adaptation, however, allows a limited response to a sinusoidal signal so that the system can eliminate "whistling" when it occurs in the hearing aid. The constraints greatly reduce the probability that the adaptive filter will cancel a sinusoidal or narrow band input signal, but still allow the system to track the feedback path changes that occur in daily use. The constrained adaptation uses a set of reference filter coefficients that describe the most accurate available model of the feedback path.

Two procedures have been developed for LMS adaptation with a constraint on the norm of the adaptive filter used to model the feedback path. Both approaches are designed to prevent the adaptive filter coefficients from deviating too far from the reference coefficients. In the first approach, the distance of the adaptive filter coefficients from the reference coefficients is determined, and the norm of the adaptive filter coefficient vector is clamped to prevent the distance from exceeding a preset threshold. In the second approach, a cost function is used in the adaptation to penalize excessive deviation of the adaptive filter coefficients from the reference coefficients.

Adaptation with Clamp: The feedback cancellation uses LMS adaptation to adjust the FIR filter that models the feedback path (FIGS. 3 and 7 illustrate the LMS adaptation). The processing is most conveniently implemented in block time domain form, with the adaptive coefficients updated once for each block of data.

Conventional LMS adaptation adapts the filter coefficients $w_k(m)$ over the block of data to minimize the error signal given by $$\varepsilon(m) = \sum_{n=0}^{N-1} e_n^2(m) = \sum_{n=0}^{N-1} (([s_n(m) - v_n(m)]))^2, \tag{1}$$

where $s_n(m)$ is the microphone input signal and $v_n(m)$ is the output of the FIR filter modeling the feedback path for data block m, and there are N samples per block. The LMS coefficient update is given by $$w_k(m+1) = w_k(m) + 2\mu \sum_{n=0}^{N-1} e_n(m) g_{n-k}(m), \tag{2}$$

where $g_{n-k}(m)$ is the input to the adaptive filter, delayed by k samples, for block m.

In general, one wants the tightest bound on the adaptive filter coefficients that still allows the system to adapt to expected changes in the feedback path such as those caused by the proximity of a telephone handset. The bound is needed to prevent coloration artifacts or temporary instability in the hearing aid which can often result from unconstrained growth of the adaptive filter coefficients in the presence of a sinusoidal or narrow band input signal. The measurements of the feedback path indicate that the path response changes by about 10 dB in magnitude when a telephone handset is placed near the aided ear, and that this relative change is independent of the type of earmold used. The constraint on the norm of the adaptive filter coefficients can thus be expressed as $$\frac{\sum_{k=0}^{K-1} |w_k(m) - w_k(0)|}{\sum_{K=0}^{K-1} |w_k(0)|} < \gamma, \tag{3}$$

where $w_k(m)$ are the current filter coefficients, $W_k(0)$ are the filter coefficients determined during initialization in the hearing aid dispenser's office, the FIR filter consists of K taps, and $\gamma \sim 2$ to give the desired headroom above the reference condition. The clamp given by Eq (3) allows the adaptive filter coefficients to adapt freely when they are close to the initial values, but prevents the filter coefficients from growing beyond the clamp boundary.

Adaptation with Cost Function: The cost function algorithm minimizes the error signal combined with a cost function based on the magnitude of the adaptive coefficient vector:

$$\varepsilon(m) = \sum_{n=0}^{N-1} [s_n(m) - v_n(m)]^2 + \beta \sum_{k=0}^{K-1} [w_k(m) - w_k(0)]^2, \tag{4}$$

where $\beta$ is a weighting factor. The new constraint is intended to allow the feedback cancellation filter to freely adapt near the initial coefficients, but to penalize coefficients that deviate too far from the initial values.

The LMS coefficient update for the cost function algorithm is given by $$w_k(m+1) = w_k(m) - 2\mu\beta[w_k(m) - w_k(0)] + 2\mu \sum_{n=0}^{N-1} e_n(m) g_{n-k}(m). \tag{5}$$

The modified LMS adaptation uses the same cross correlation operation as the conventional algorithm to update the coefficients, but combines the update with an exponential decay of the coefficients toward the initial values. At low input signal or cross correlation levels the adaptive coefficients will tend to stay in the vicinity of the initial values. If the magnitude of the cross correlation increases, the coefficients will adapt to new values that minimize the error as long as the magnitude of the adaptive coefficients remains close to that of the initial values. However, large deviations of the adaptive filter coefficients from the initial values are prevented by the exponential decay which is constantly pushing the adaptive coefficients back towards the initial values. Thus the exponential decay greatly reduces the occurrence of processing artifacts that can result from unbounded growth in the magnitude of the adaptive filter coefficients.

A need remains in the art for apparatus and methods to eliminate "whistling" in unstable hearing aids while providing an accurate estimate of the feedback path.

SUMMARY OF THE INVENTION

The present invention comprises a new approach to improved feedback cancellation in hearing aids. The approach adapts a first filter that. models the quickly varying portion of the hearing aid feedback path, and adapts a second filter that is used either as a reference filter for constrained adaptation or to model more slowly varying portions of the feedback path. The first filter that models the quickly varying portion of the feedback path is adaptively updated on a continuous basis. The second filter is updated only when the hearing aid signals indicate that an accurate estimate of the feedback path can be obtained. Changes in the second filter are then monitored to detect changes in the hearing aid feedback path.

An audio system, such as a hearing aid, according to the present invention, comprises a microphone or the like for providing an audio signal, feedback cancellation means which includes means for estimating a physical feedback signal of the audio system and means for modelling a signal processing feedback signal to compensate for the estimated physical feedback signal, an adder connected to the microphone and the output of the feedback cancellation for subtracting the signal processing feedback signal from the audio signal to form a compensated audio signal, audio system processing means, connected to the output of the subtracting means, for processing the compensated audio signal, and means for estimating the condition of the audio signal and generating a control signal based upon the condition estimate. The feedback cancellation means forms a feedback path from the output of the audio system processing means to the input of the subtracting means and includes a reference filter and a current filter, wherein the reference filter varies only when the control signal indicates that the audio signal is suitable for estimating physical feedback, and wherein the current filter varies at least when the control signal indicates that the signal is not suitable for estimating physical feedback.

In some embodiments, the current filter varies more frequently than the reference filter, usually continuously. This occurs in embodiments wherein the feedback signal is filtered through the current filter and the current filter is constrained by the reference filter.

The current filter may only be adapted when the control signal indicates that the signal is not suitable for estimating physical feedback, in embodiments wherein the feedback signal is filtered through the current filter and the reference filter, and the current filter represents a deviation applied to the reference filter.

Frequently the means for estimating the condition of the audio signal comprises means for detecting whether the signal is broadband, and the reference filter varies only when the control signal indicates that the signal is broadband. For example, the audio system processing means computes the signal spectrum of the audio signal, the means for estimating computes the ratio of the minimum to the maximum input power spectral density and generates a control signal based upon the ratio,and the control signal indicates the audio signal is suitable when the ratio exceeds a predetermined threshold. As another example, the audio system processing means computes the correlation matrix of the audio signal, the means for estimating computes the condition number of the correlation matrix and generates a control signal based upon the condition number, and the control signal indicates the audio signal is suitable when the condition number falls below a predetermined threshold.

In the preferred embodiment, the reference filter is monitored to detect significant changes in the feedback path of the audio system. Also, constraining means prevents the current filter (or the reference filter combined with the deviation filter) from deviating excessively from the reference filter.

DESCRIPTION OF THE PREFERRED EMBODIMENT

FIGS. 1, 3, 5, 7, and 9 illustrate various embodiments of the present invention, while FIGS. 2, 4, 6, 8, and 10 illustrate the algorithms performed by the embodiments. Similar reference numbers are used for similar elements between FIGS. 1, 3, 5, 7, and 9 and between FIGS. 2, 4, 6, 8, and 10.

Figure 11:
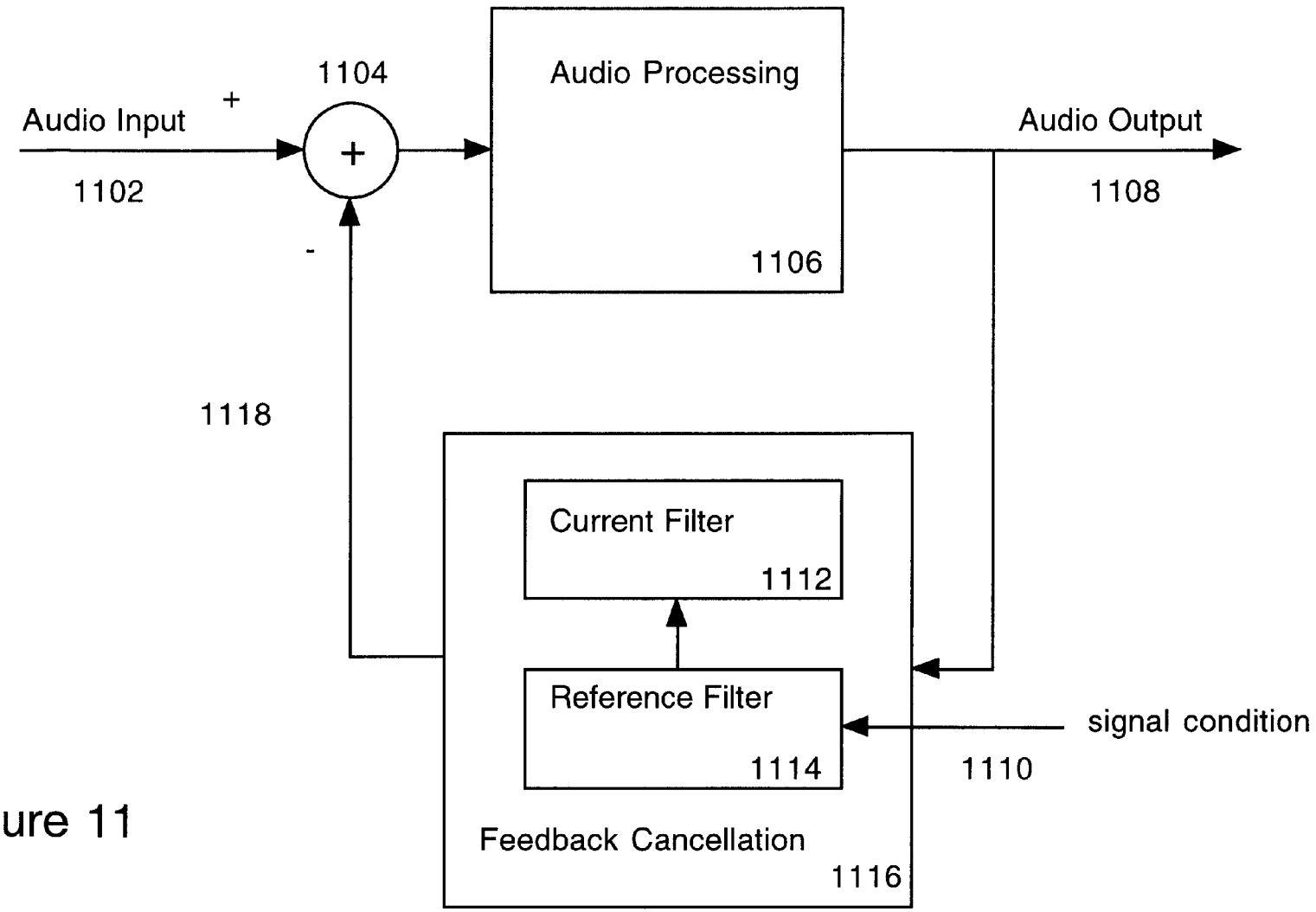
FIG. 11 is a simplified block diagram illustrating the basic concepts of the present invention.

FIG. 11 is a simplified block diagram illustrating the basic concept of the present invention. The system includes a signal processing feedback cancellation block 1116 designed to cancel out the physical feedback inherent in the system. Adder 1104 subtracts feedback signal 1118, representing the physical feedback of the system, from audio input 1102. The result is processed by audio processing block 1106 (compression or the like) and the result is output signal 1108. Audio output signal 1108 is also fed back and filtered by block 1116.

Feedback cancellation block 1116 comprises two filters, a current filter 1112 and reference filter 1114. Reference filter 1114 is updated only when a signal 1110, indicating the condition of the audio signal, indicates that the signal condition is such that an accurate estimate of the feedback path can be made. Current filter 1112 is updated at least when the signal 1110 indicates that the audio signal is not suitable for an estimate of the feedback to be made. This is the case when reference filter 1114 represents the feedback path estimate that is made when the signal is suitable, and current filter 1112 represents the deviation from the more stable reference filter 1114, which may be required to compensate for a sudden change in the feedback path (caused, for example, by the presence of a tone). Current filter feedback signal 1108 is then filtered through both current filter (or deviation filter) 1112 and slower varying filter 1114 (see FIGS. 5 and 7).

Feedback cancellation, in which the feedback signal is estimated and subtracted from the microphone signal, is not discussed in detail herein. Feedback cancellation typically uses an adaptive filter that models the dynamically changing feedback path within the hearing aid. Particularly effective feedback cancellation schemes are disclosed in patent application Ser. No. 08/972,265, entitled "Feedback Cancellation Apparatus and Methods," incorporated herein by reference and patent application Ser. No. 09/152,033 entitled "Feedback Cancellation Improvements," incorporated herein by reference.

In other embodiments (see FIGS. 1 and 3), reference filter 1114 still represents the feedback path estimate that is made when the signal is suitable, but current filter 1112 represents a frequently or continuously updated feedback path estimate. Feedback signal 1108 is filtered only by current filter 1112, but current filter 1112 is constrained not to deviate too drastically from reference filter 1114.

Figure 1:
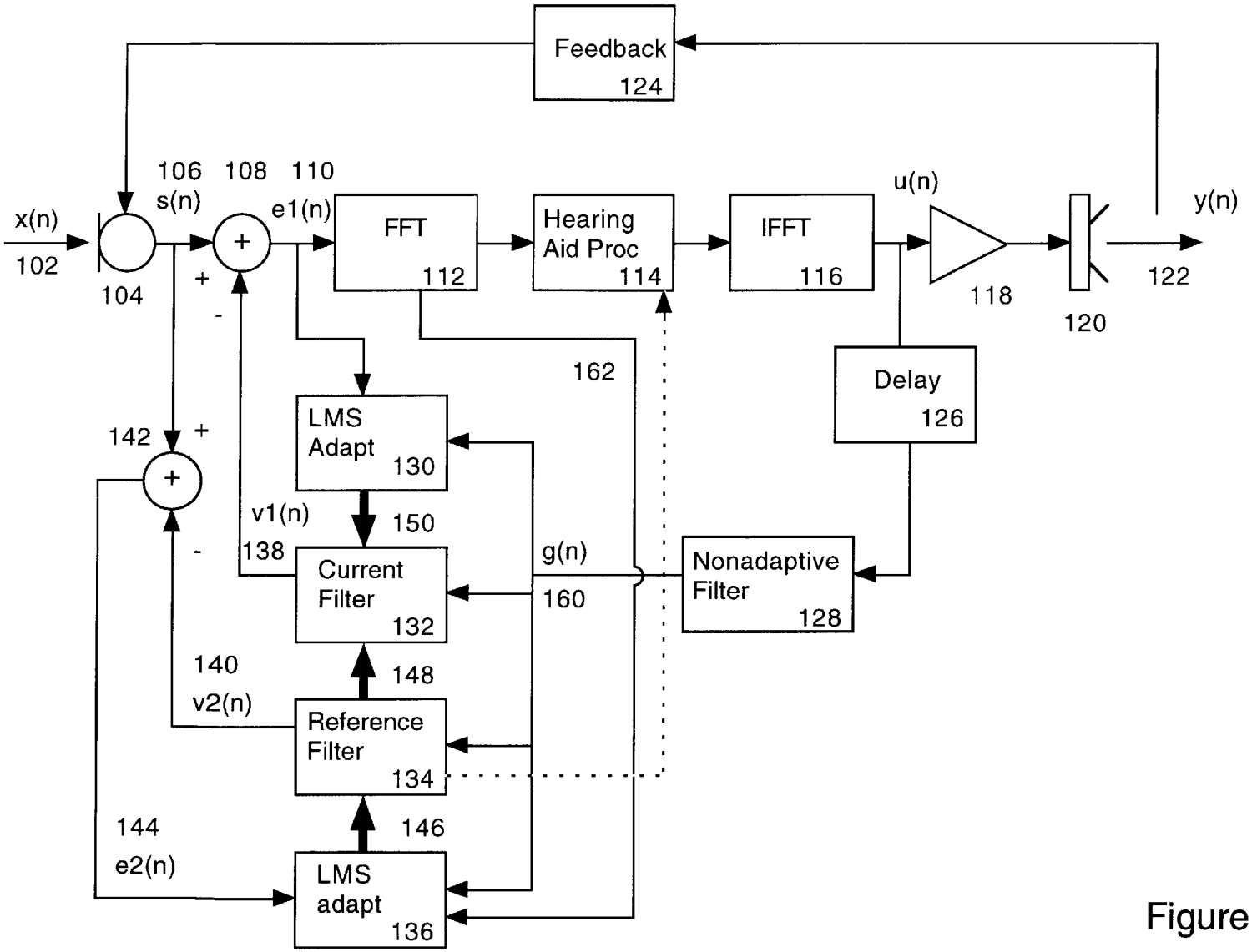
FIG. 1 is a block diagram of the first embodiment of the present invention, wherein the reference coefficient vector is allowed to adapt under certain conditions.
Figure 2:
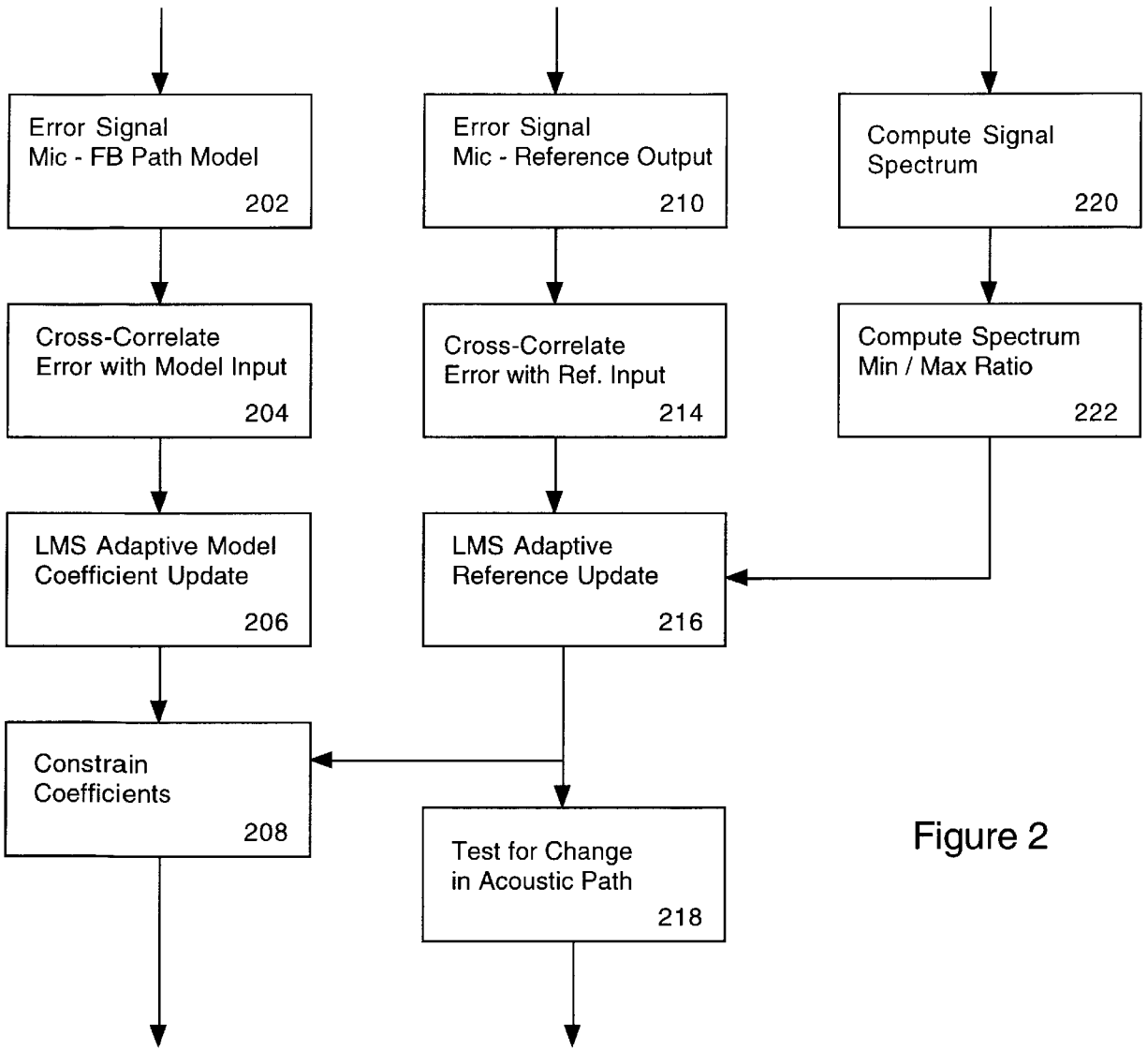
FIG. 2 is a flow diagram showing the process implemented by the embodiment of FIG. 1.

FIG. 1 is a block diagram of the first embodiment of the present invention, wherein the reference coefficient vector is allowed to adapt under certain conditions. FIG. 2 is a flow diagram showing the process implemented by the embodiment of FIG. 1. The improved feedback cancellation system shown in FIG. 1 uses constrained adaptation to prevent the adaptive filter coefficients 132 from deviating too far from the reference coefficients set at initialization. However, the reference coefficient vector 134 is also allowed to adapt; it can thus move from the initial setting to a new set of coefficients in response to changes in the feedback path. Coefficients 132 used to model the feedback path adapt continuously, reacting to changes in the feedback path as well as to feedback "whistling" or sinusoidal input signals. Reference coefficients 134, on the other hand, adapt slowly or intermittently when conditions favorable to modeling the feedback path are detected, and do not adapt in response to "whistling" or to narrow band input signals. The reference coefficients 134 are much more stable than the current feedback path model coefficients 132; the changes in reference coefficients 134 can therefore be monitored to detect significant changes in the feedback path such as would occur when a telephone handset is positioned close to the aided ear.

FIG. 1 shows the first embodiment of the present invention utilized in a conventional hearing aid system comprising an input microphone 104, a fast Fourier transform block 112, a hearing aid processing block 114, an inverse fast Fourier transform block 116, an amplifier 118, and a receiver 120. The actual feedback of the system is indicated by block 124. The sound input to the hearing aid is indicated by signal 102, and the sound delivered to the wearer's ear is indicated by signal 122.

The current (continuously updated) feedback path model consists of an adaptive FIR filter 132 in series with a delay 126 and a nonadaptive FIR or IIR filter 128, although adaptive filter 132 can be used without additional filtering stages 126, 128 or an adaptive IIR filter could be used instead. Error signal 110, e1 (n), is the difference between incoming signal 106, s(n), and current feedback path model output signal 138, v1 (n).

The reference (intermittently updated) feedback path consists of an adaptive filter 134 (for example a FIR filter) in series with delay 126 and nonadaptive filter 128. There is a second error signal 144, e2(n), which is the difference between incoming signal 106 and the output 140 of reference filter 134 given by v2(n). Error signal 110 is used for the LMS adaptation 130 of adaptive FIR feedback path model filter coefficients 132, and error signal 144 is used for the LMS adaptation 136 of the reference filter coefficients 134.

The error in modeling the feedback path is given by $\xi(n)$, the difference between the true and the modeled FIR filter coefficients. Siqueira et al (Siqueira, M. G., Alwan, A., and Speece, R., "Steadystate analysis of continuous adaptation systems in hearing aids", Proc. 1997 IEEE Workshop on Applications of Signal Processing to Audio and Acoustics, New Paltz, N.Y., Oct. 19–22, 1997) have shown that for a feedback path modeled by an adaptive FIR filter $$E[\xi]=R^{-1}p, \tag{6}$$

where $p=E[g(n)s(n)]$ and $R=E[g(n)g^T(n)]$. The error in representing model filter coefficients will be zero if the system input 106, s(n), and the adaptive filter input 160, g(n), are uncorrelated. If these two signals are correlated, however, then a bias will be present in the model of the feedback path. For a sinusoidal input the bias will be extremely large because the expected cross correlation p will be large, and the correlation matrix R will be singular or nearly so. Thus the inverse of the correlation matrix will have very large eigenvalues that will greatly amplify the non-zero cross-correlation.

The improved feedback cancellation is designed to update the reference coefficients when the bias given by Equation (6) is expected to be small, and to eschew updating the reference coefficients when the bias is expected to be large. From Equation (6), the bias is expected to be large when the input signal is periodic or narrow band, signal conditions that will yield a large condition number (ratio of the largest to the smallest eigenvalue) for the correlation matrix R. The condition number is a very time consuming quantity to calculate, but Haykin (Haykin, S., "Adaptive Filter Theory: 3rd Edition", Prentice Hall:Upper Saddle River, N.J., 1996, pp 170–171) has shown that the condition number for a correlation matrix is bounded by the ratio of the maximum to the minimum of the underlying power spectral density. Thus the ratio of the input power spectral density maximum to minimum can be used to estimate the condition number directly from the FFT of the input signal.

The resulting feedback cancellation algorithm is presented in FIG. 2. Referring back to FIG. 1, the adaptive filter coefficients 132 for the feedback path model are updated for each data block. The reference filter coefficients 134 are updated only when the correlation matrix condition number is small, indicating favorable conditions for the adaptation. The condition number 162 is estimated from FFT 112 of the input signal 106, although other signals could be used, as well as techniques not based on the signal FFT. If the power spectrum minimum/maximum is large, the condition number is small and the reference coefficients are updated. If the power spectrum minimum/maximum is small, the condition number is large and the reference coefficients are not updated. Returning to FIG. 2, Error signal 110 is computed in step 202 and cross correlated with model input 160 in step 204 (block 130 of FIG. 1). The results of this cross correlation (signal 150 in FIG. 1) are used to update the current model coefficients 132, but the amount the coefficients can change is constrained in step 208 as described below.

In step 220, the signal spectrum of the incoming signal is computed (e.g. in FFT block 112 of FIG. 1). Step 222 computes the min/max ratio of the spectrum to generate control signal 162. In step 210, error signal 144 is computed (adder 142 subtracts signal 140 from input signal 106). Step 214 cross correlates error 144 with reference input 162 (in block 136). Step 216 updates reference coefficients 134 (via signals 146) if (and only if) the output from step 222 indicates that the signal is of sufficient quality to warrant updating coefficients 134. Step 208 uses reference coefficients 134 to constrain the changes to model coefficients 132 (via signals 148). Finally, step 218 tests for changes in the acoustic path (indicated by significant changes in reference coefficients 134).

A monotonically increasing function of the power spectrum minimum/maximum can be used (via control signal 162) to control the fraction of the LMS adaptive update that is actually used for updating reference coefficients 134 on any given data block. Other functions of the input signal that can be used to estimate favorable conditions for adapting the reference coefficient vector include the ratio of the maximum of the power spectrum to the total power in the spectrum, the maximum of the power spectrum, the maximum of the input signal time sequence, and the average power in the input time sequence. Signals other than the hearing aid input 106 can also be used for estimating favorable conditions; such signals include intermediate signals in the processing 114 for the hearing impairment, the hearing aid output 122, and the input to the adaptive portion of the feedback path model 160.

A further consideration is the level of the ambient signal at the microphone relative to the level of the signal at the microphone due to the feedback. The present inventor (Kates, J. M., "Feedback cancellation in hearing aids: Results from a computer simulation", IEEE Trans. Signal Proc., Vol. 39, pp 553–562, 1991) has shown that the ratio of these signal levels has a strong effect on the accuracy of the adaptive feedback path model. In a compression hearing aid, the lower the ambient signal level the higher the gain, resulting in a more favorable level of the feedback relative to that of the ambient signal at the microphone and hence giving better convergence of the adaptive filter and a more accurate feedback path model. Thus the rate of adaptation of the reference coefficient vector in a compression hearing aid can be increased at low input signal levels or equivalently for high compression gain values. In a hearing aid allowing changes in the hearing aid gain, increasing the gain will also lead to improvements in the ratio of the feedback path signal relative to the ambient signal measured at the hearing aid microphone and hence allows more rapid adaptation of the reference filter. This modification of the rate of adaptation of the reference coefficient vector for changes in the hearing aid gain would be in addition to the algorithm shown in FIG. 2.

The reference coefficients 134 will be an accurate representation of the slowly varying feedback path characteristics. Reference coefficients 134 can therefore be used to detect changes in the feedback path, that can in turn be used to control the hearing aid signal processing 114. Examples would be to change the hearing aid frequency response or compression characteristics when a telephone handset is detected, or to reduce the high frequency gain of the hearing aid if a large increase in the magnitude of the feedback path response were detected. Changes in the norm, in one or more coefficients, or in the Fourier transform of the reference coefficient vector can be used to identify meaningful changes in the feedback path.

The system of FIG. 1 and the associated algorithm of FIG. 2 nearly double the number of arithmetic operations needed for the feedback cancellation when compared to a system that does not adapt the reference filter coefficients. A simpler system (shown in FIG. 3) and algorithm (shown in FIG. 4) can be used if there is not enough processing capacity for the complete system. In the simpler system, reference coefficients 334 are updated by being averaged with feedback path model coefficients 332 rather than by using LMS adaptation.

Let r(m) be the spectrum minimum/maximum for data block m. Track r(m) with a peak detector having a slow attack and a fast release time constant to give a valley detector, and let d(m) denote the valley detector output with $0 \leqq d(m) \leqq 1$. The value of d(m) will converge to 1 when there have been a succession of data blocks all having broadband power spectra; under these conditions the feedback path model will tend to converge to the actual feedback path. On the other hand, d(m) will approach 0 given a narrow band or sinusoidal input signal, and will drop to a small value whenever it appears that the input signal could lead to a large mismatch between the feedback path model and the actual feedback path. The value of d(m), or a monotonically increasing function of d(m), can therefore be used to control the amount of the feedback path model coefficients averaged with the reference coefficients to produce the new set of reference coefficients.

Figure 3:
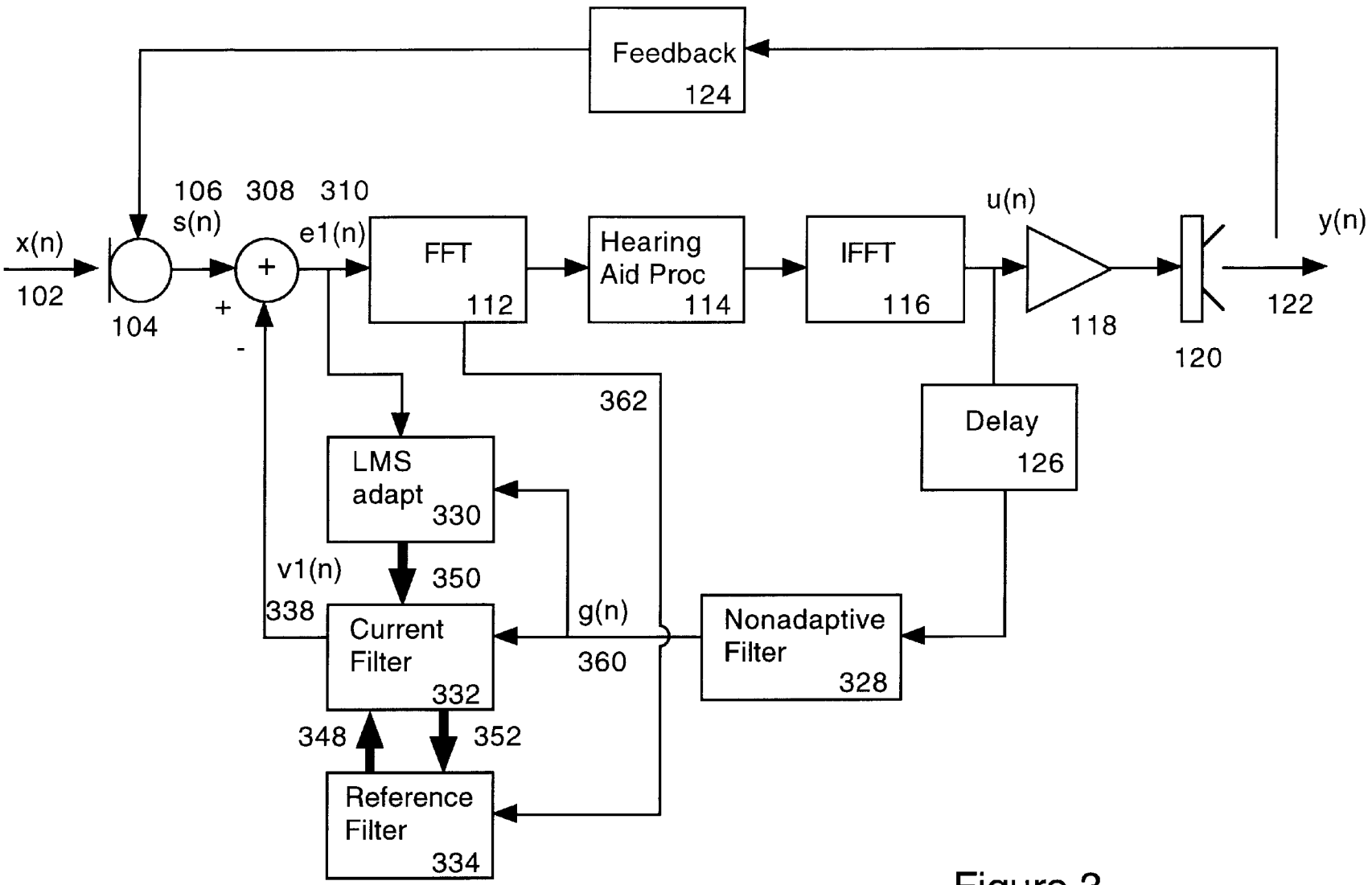
FIG. 3 is a block diagram of a second embodiment of the present invention (simplified from the embodiment of FIG. 1), wherein the reference coefficient vector is more simply updated by being averaged with the feedback path model coefficients.
Figure 4:
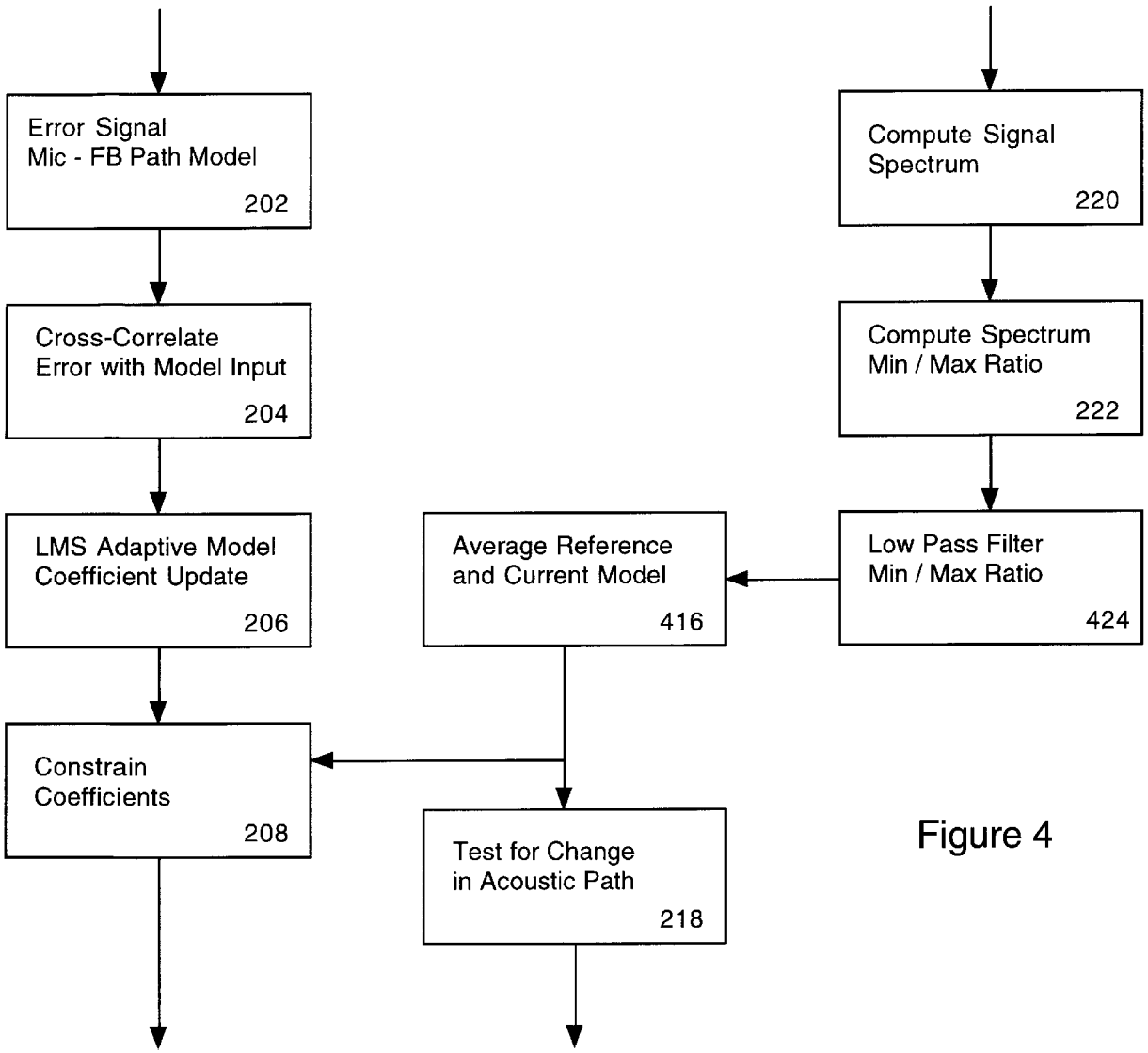
FIG. 4 is a flow diagram showing the process implemented by the embodiment of FIG. 3.

The resulting system is shown in FIG. 3 and the algorithm flow chart is presented in FIG. 4. FIG. 3 is very similar to the system shown in FIG. 1, except that the reference coefficients 134 are not LMS adapted, which means adder 142 and LMS adapt block 136 can be removed. Current feedback path model 332 is updated for every data block, and thus responds to the changes in the feedback path as well as to a sinusoidal input signal. For a broadband input signal 106, the reference coefficients 334 are slowly averaged with the feedback path model coefficients (via signal 352) to produce the updated reference coefficients, and the 10 averaging is slowed or stopped when the input signal bandwidth is reduced (controlled by signal 362). In a compression hearing aid, the rate of averaging can also be increased in response to decreases in the input signal level 106 or increases in the compression gain. In a hearing aid having a volume control or allowing changes in gain, the rate of averaging can be increased as the gain is increased.

FIG. 4 is very similar to FIG. 2, except that steps 210 (computing the second error signal) and 214 (cross correlating the second error signal with the reference input) have been removed and block 216 (LMS adaptive reference update) has been replaced with block 416 (averaging the reference and the current model). Block 424 has been added to low pass filter the min/max ratio of the spectrum. The output of step 424 controls whether the reference coefficients are averaged with the model coefficients.

Figure 5:
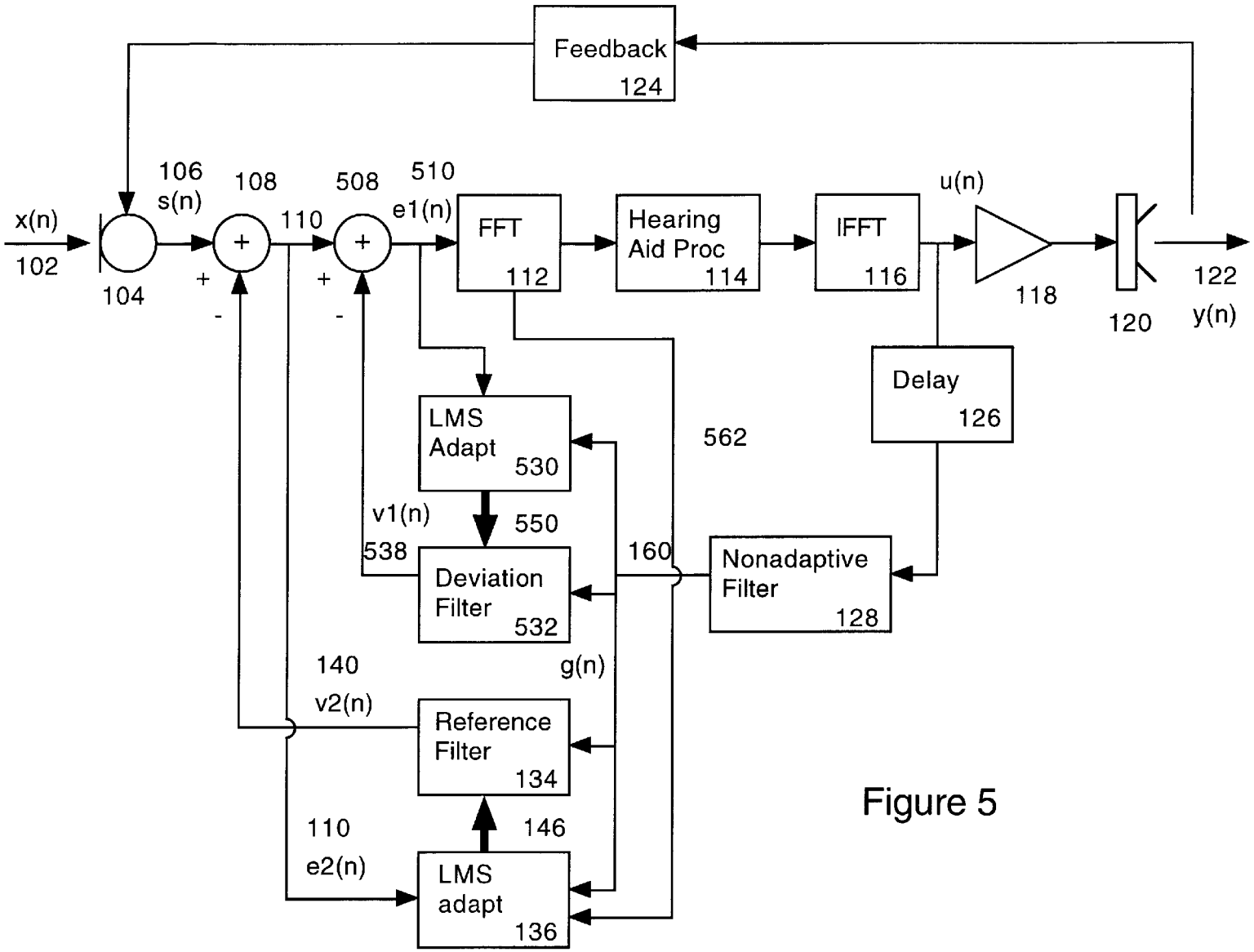
FIG. 5 is a block diagram of a third embodiment of the present invention (similar to the embodiment of FIG. 1, but utilizing a more parallel structure), wherein the reference coefficient vector is allowed to adapt under certain conditions.

In the system shown in FIG. 1, the first filter is the current feedback path model and represents the entire feedback path. The second filter is the reference for the constrained adaptation, and the second filter coefficients are updated independently when the data is favorable. An alternative approach is to model the feedback path with two adaptive filters 532, 134 in parallel as shown in FIG. 5. The reference filter 134 in this system is given by the reference coefficients (as in FIG. 1), and current (or deviation) filter, 532 represents the deviation of the modeled feedback path from the reference. Note that in FIGS. 5 and 7, the current filter (filter 1112 of FIG. 11) is called a deviation filter, to more clearly identify the function of the current filter in these embodiments. The deviation filter 532 is still adapted using constrained LMS adaptation; the clamp uses the distance from the zero vector instead of the distance from the reference coefficient vector, and the cost function approach decays the deviation coefficient vector towards zero instead of towards the reference coefficient vector. Under ideal conditions the reference coefficients 134 will give the entire feedback path and the deviation signal 538 out of filter 532 will be zero. Deviation filter 532 is adapted for every block of data, and the reference filter coefficients 534 are adaptively updated whenever the input data is favorable. In a compression hearing aid, the rate of adaptation of the reference filter coefficients can also be increased in response to decreases in the input signal level or increases in the compression gain. In a hearing aid allowing changes in the hearing aid gain, more rapid adaptation of the reference filter would occur as the gain is increased.

A somewhat different interpretation of the deviation and reference zero filters is that reference filter 134 represents the best estimate of the feedback path, and deviation filter 532 represents the deviation needed to suppress oscillation should the hearing aid temporarily become unstable. With this interpretation, reference filter coefficients 134 should be updated whenever the incoming spectrum is flat, and deviation filter coefficients 532 should be updated whenever the incoming spectrum has a large peak/valley ratio. The spectrum minimum/maximum ratio can therefore be used to control the proportion of the adaptive coefficient update vectors used to update the deviation and reference coefficients for each data block. An alternative would be to use the spectrum minimum/maximum ratio to control a switch that selects which set of coefficients is updated for each data block.

Figure 6:
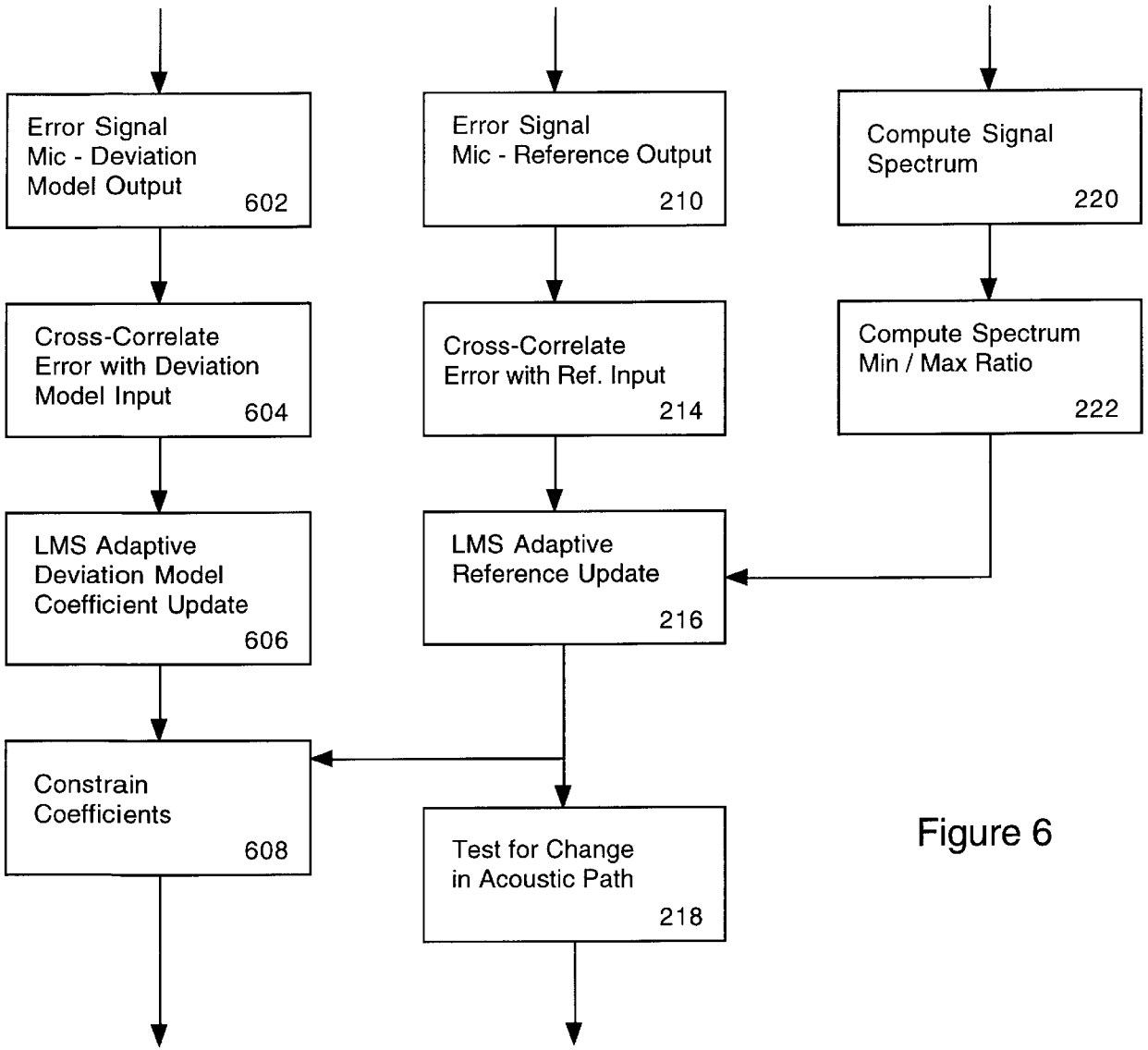
FIG. 6 is a flow diagram showing the process implemented by the embodiment of FIG. 5.

The algorithm flow chart for the parallel filter system of FIG. 5 is presented in FIG. 6. This flow chart is nearly identical with the flow chart of FIG. 2. The only difference between the two algorithms is that for the parallel system, in step 602, output 538 of deviation filter 532 is subtracted from 110 by adder 508, to give the error signal 510. LMS update 530 cross correlates error signal 510 and signal 160 in step 604. Deviation filter coefficients 532 are then updated in step 606 (via signals 550). Deviation coefficient updates are constrained in step 608. Thus, the computational requirements for the parallel system of FIG. 5 will be virtually identical with those for the system of FIG. 1.

Figure 7:
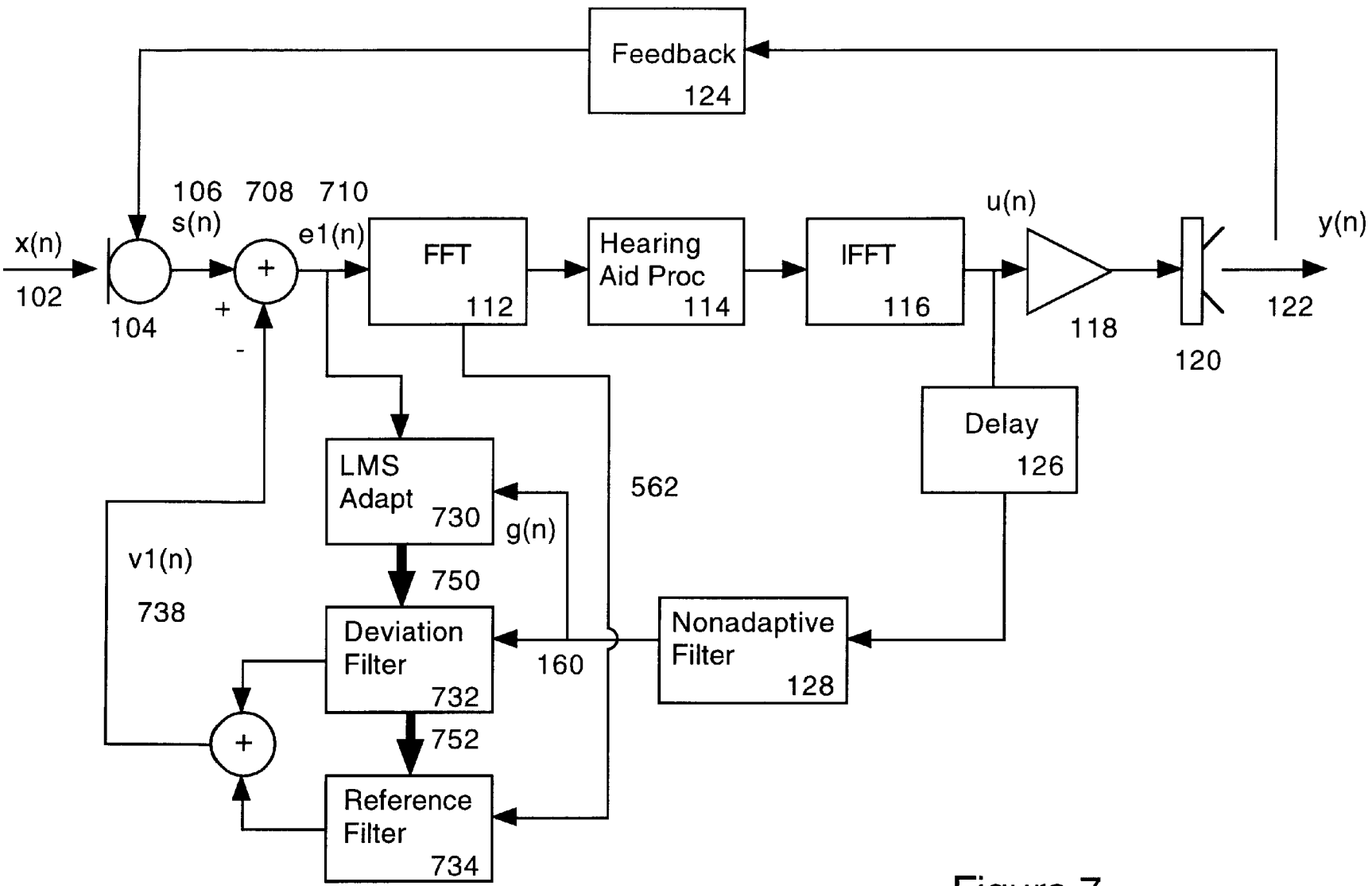
FIG. 7 is a block diagram of a fourth embodiment of the present invention (simplified from the embodiment of FIG. 5), wherein the reference coefficient vector is more simply updated by being averaged with the feedback path model coefficients.

In FIG. 7, the alternative system of FIG. 5 has been simplified in much the same way that the system of FIG. 1 was simplified to give the system of FIG. 3. A portion of deviation filter coefficients 732 is added to reference filter coefficients 734 whenever conditions are favorable. As in the case of the earlier simplified system of FIG. 3, favorable conditions are based on the output 562 of the valley detected spectrum minimum/maximum ratio. The value of 562, or a monotonically increasing function of 562, can therefore be used to control the amount of deviation coefficients 732 added to reference coefficients 734 to produce the new set of reference coefficients 734. The simplified parallel system is shown in FIG. 7, and the algorithm flow chart is presented in FIG. 8.

Figure 8:
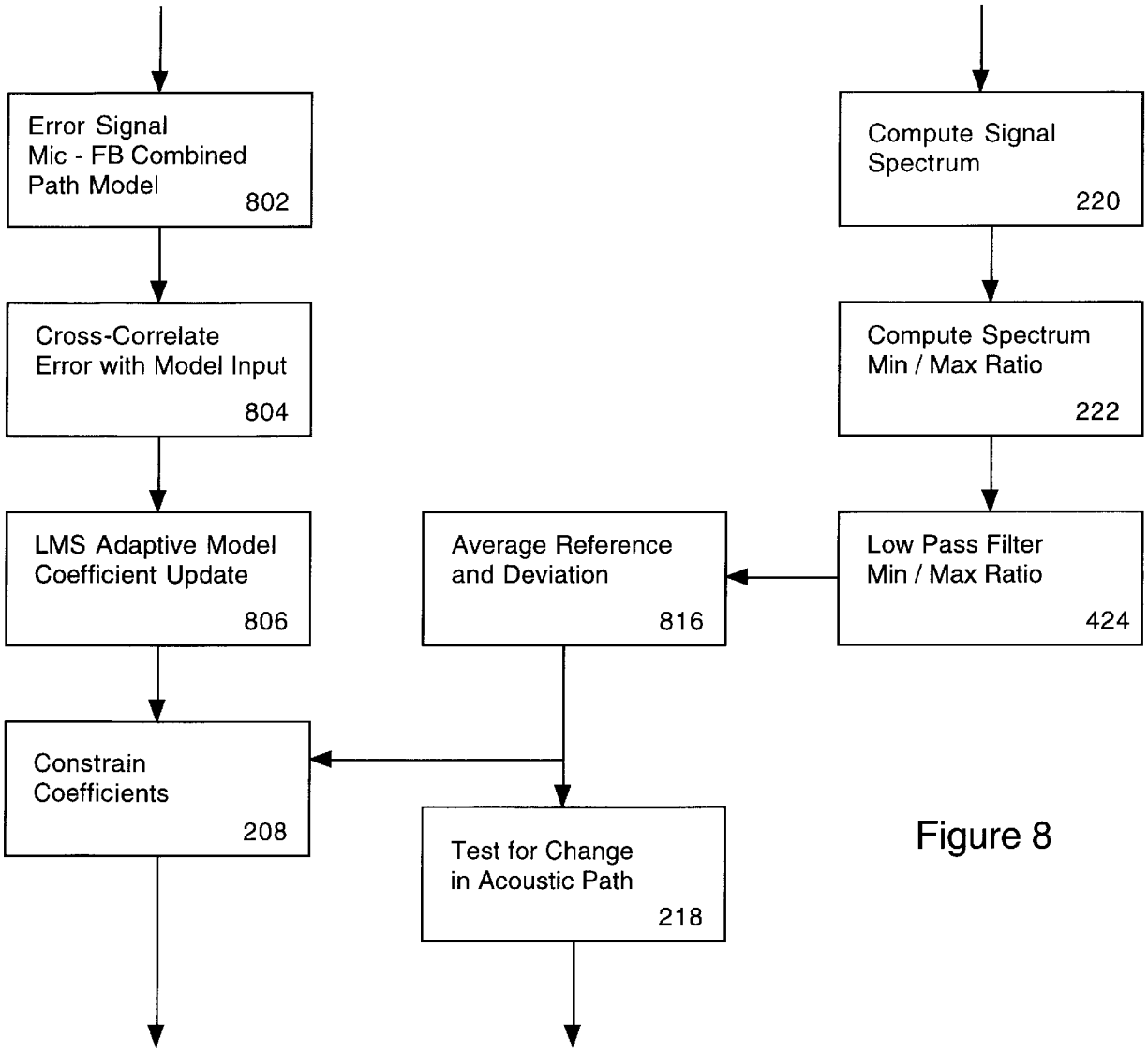
FIG. 8 is a flow diagram showing the process implemented by the embodiment of FIG. 7.

In step 802 of FIG. 8, the combined outputs of deviation filter 732 and reference filter 734 form signal 738, which is subtracted from input 106 by adder 708 to form error signal 710. In step 804, LMS adapt block 730 cross correlates error signal 710 with model input 160. In step 806, deviation coefficients 732 are updated via signals 750. The amount of adaptation is constrained in step 208 filter as described above. Step 220 computes the signal spectrum, step 222 computes the min/max ratio, and step 424 low pass filters the ratio as described earlier. In step 816, if conditions dictate, the reference filter 734 is replaced by an averaged version of the reference plus the deviation.

In a compression hearing aid, the rate of averaging can also be increased in response to decreases in the input signal level 106 or increases in the compression gain. In a hearing aid having a volume control or allowing changes in gain, the rate of averaging can be increased as the gain is increased. The computational requirements for this simplified system are similar to those for the system of FIG. 3 since the reference and deviation filter coefficients can be combined for each data block prior to the FIR filtering operation.

Figure 9:
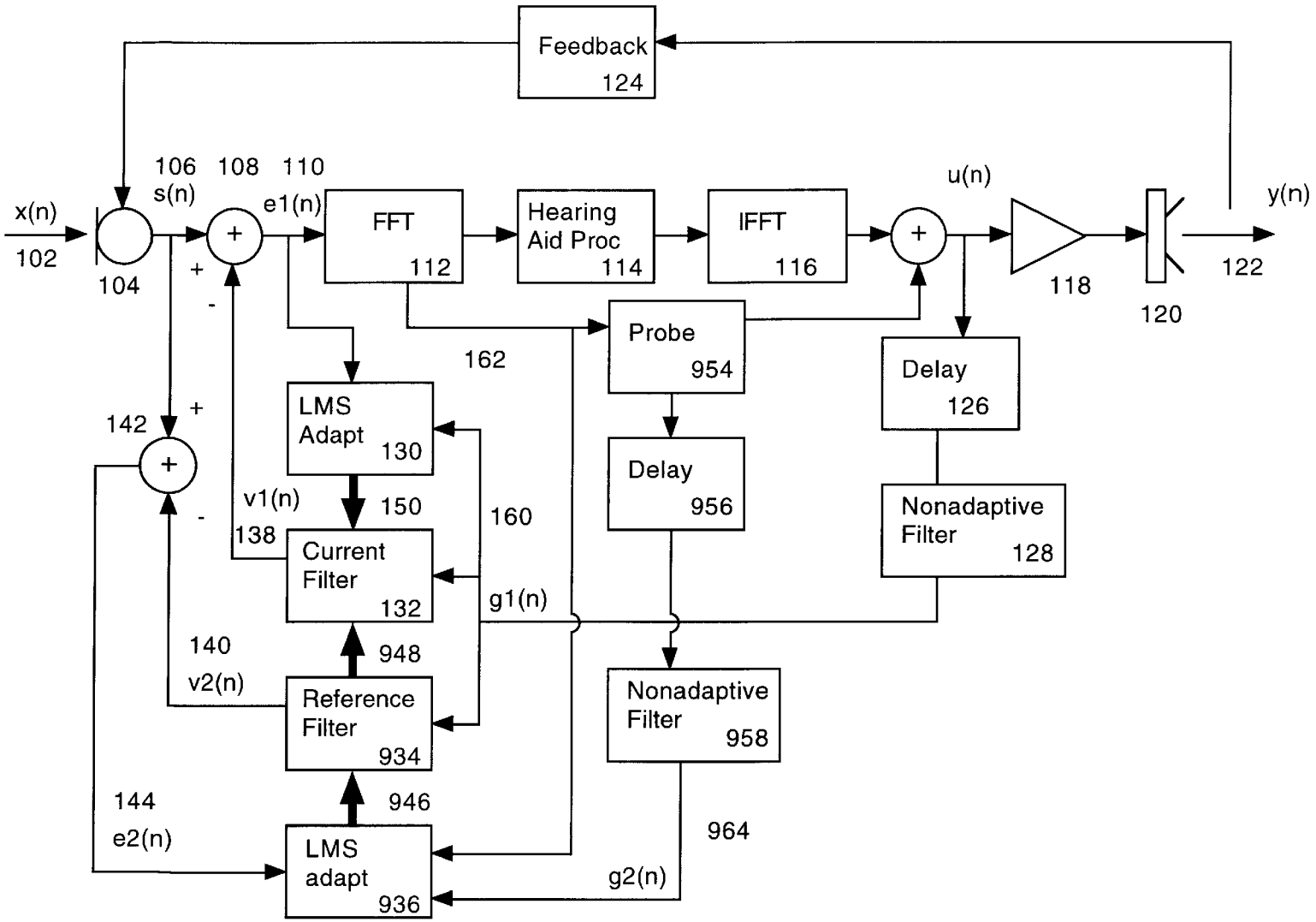
FIG. 9 is a block diagram of a fifth embodiment of the present invention (similar to the embodiment of FIG. 1, but utilizing a probe. signal), wherein the reference coefficient vector is allowed to adapt under certain conditions.

The adaptation of the reference coefficients can be improved by injecting a noise probe signal into the hearing aid output. FIG. 9 shows the system of FIG. 1 with the addition of a probe signal 954. The adaptation of reference coefficients 934 uses the cross correlation of the error signal 144, e2(n), with the delayed, 956, and filtered, 958, probe signal 964, g2(n). This cross correlation gives a more accurate estimate of the feedback path than is typically obtained by cross correlating the error signal with the adaptive filter input g1(n) as shown in FIG. 1. A constant amplitude probe signal can be used, and the adaptation of the reference filter coefficients can be performed on a continuous basis. However, a system with better accuracy will be obtained when the level of probe signal 954 and the rate of adaptation of reference filter coefficients 934 are controlled by the input signal characteristics, e.g. by signal 162. The preferred probe signal is random or pseudo-random white noise, although other signals can also be used.

The probe signal amplitude and the rate of adaptation are both increased when the input signal has a favorable spectral shape and/or the input signal level is low. Under these conditions the cross correlation operation 936 will extract the maximum amount of information about the feedback path because the ratio of the feedback path signal power to the hearing aid input signal power at the microphone will be at a maximum. Adaptation (via signal 946) of the reference filter coefficients is slowed or stopped and the probe signal amplitude reduced when the input signal level is high; under these conditions the cross correlation is much less effective at producing accurate adaptive filter updates and it is better to hold the reference filter coefficients at or near their previous values. Other statistics from the input or other hearing aid signals as described for the system of FIG. 1 could be used as well to control the probe signal amplitude and the rate of adaptation.

Figure 10:
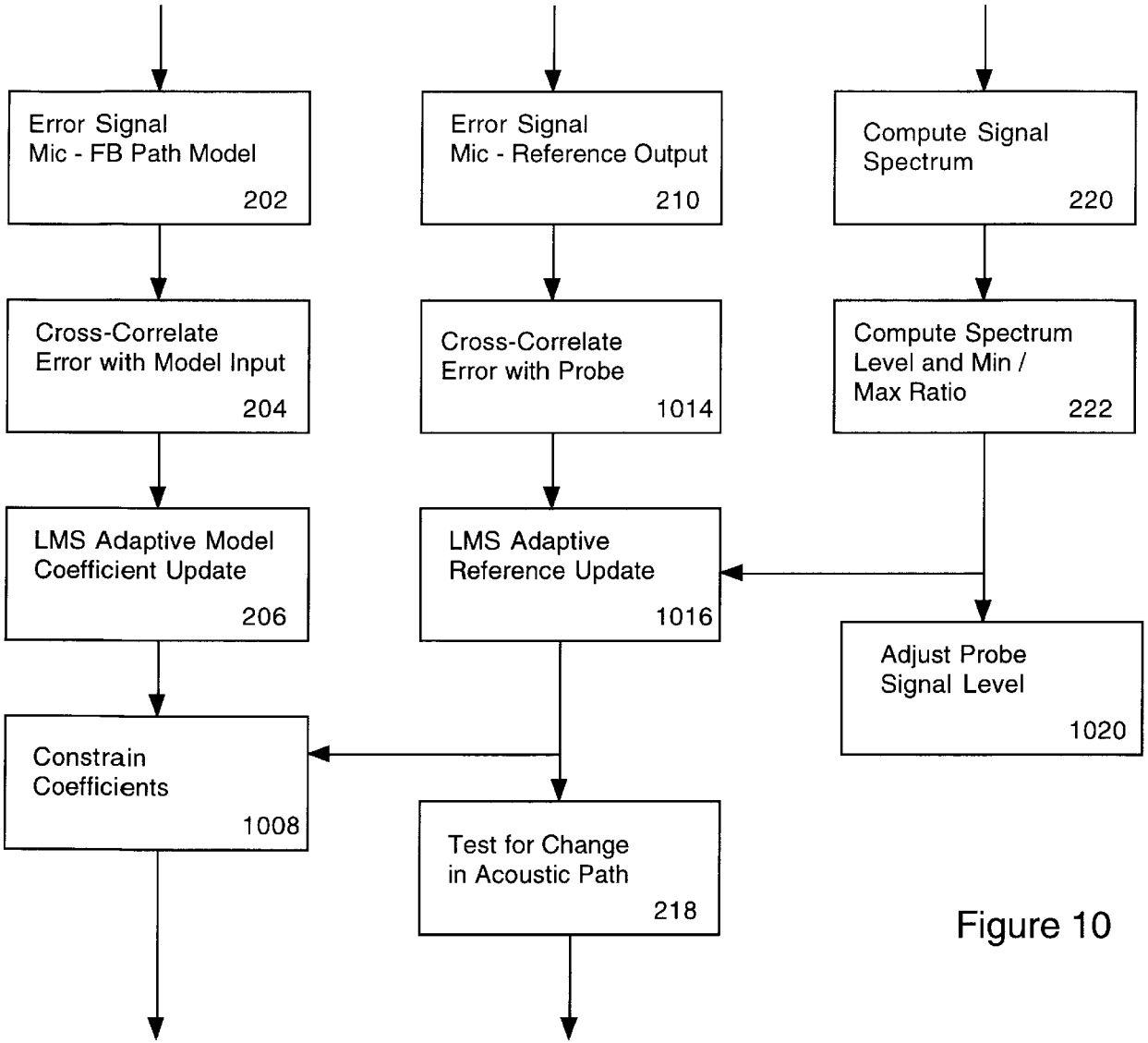
FIG. 10 is a flow diagram showing the process implemented by the embodiment of FIG. 9.

The adaptive algorithm flow chart is shown in FIG. 10. This algorithm is very similar to that of FIG. 1, except as follows.

Cross correlation step 1014 cross correlates signal 964 derived from probe signal 954 with error signal 144, in LMS adapt block 936. In step 1016, filter 934 is updated, via signals 946. In step 1020, the probe signal level 954 is adjusted in response to the incoming signal level and minimum/maximum ratio.

What is claimed is:

1. An audio system comprising:

means for providing an audio signal;

feedback cancellation means including means for estimating a physical feedback signal of the audio system, and means for modelling a signal processing feedback signal to compensate for the estimated physical feedback signal;

subtracting means, connected to the means for providing an audio signal and the output of the feedback cancellation means, for subtracting the signal processing feedback signal from the audio signal to form a compensated audio signal;

audio system processing means, connected to the output of the subtracting means, for processing the compensated audio signal;

means for estimating the condition of the audio signal and generating a control signal based upon the condition estimate;

wherein said feedback cancellation means forms a feedback path from the output of the audio system processing means to the input of the subtracting means and includes:

a reference filter, and a current filter, wherein the reference filter varies only when the control signal indicates that the audio signal is suitable for estimating physical feedback, and wherein the current filter varies at least when the control signal indicates that the signal is not suitable for estimating physical feedback.

2. The audio system of claim 1 wherein the current filter varies more frequently than the reference filter.

3. The audio system of claim 2 wherein the feedback signal is filtered through the current filter; and the current filter is constrained by the reference filter.

4. The audio system of claim 2 wherein the current filter varies continuously.

5. The audio system of claim 1 wherein the feedback signal is filtered through the current filter and the reference filter; and the current filter represents a deviation applied to the reference filter.

6. The audio system of claim 1 wherein the means for estimating the condition of the audio signal comprises means for detecting whether the signal is broadband, and the reference filter varies only when the control signal indicates that the signal is broadband.

7. The audio system of claim 6, wherein the audio system processing means comprises means for computing the signal spectrum of the audio signal; wherein the means for estimating computes the ratio of the minimum to the maximum input power spectral density and generates a control signal based upon the ratio; and wherein the control signal indicates the audio signal is suitable when the ratio exceeds a predetermined threshold.

8. The audio system of claim 6, wherein the audio system processing means comprises means for computing the correlation matrix of the audio signal; wherein the means for estimating computes the condition number of the correlation matrix and generates a control signal based upon the condition number; and wherein the control signal indicates the audio signal is suitable when the condition number falls below a predetermined threshold.

9. The audio system of claim 1, further comprising:

monitoring means for monitoring the reference filter to detect significant changes in the feedback path of the audio system.

10. The audio system of claim 1, further comprising:

constraining means for preventing the current filter from deviating excessively from the reference filter.

11. A hearing aid comprising:

a microphone for converting sound into an audio signal; feedback cancellation means including means for estimating a physical feedback signal of the hearing aid, and means for modelling a signal processing feedback signal to compensate for the estimated physical feedback signal;

subtracting means, connected to the output of the microphone and the output of the feedback cancellation means, for subtracting the signal processing feedback signal from the audio signal to form a compensated audio signal;

hearing aid processing means, connected to the output of the subtracting means, for processing the compensated audio signal;

means for estimating the condition of the audio signal and generating a control signal based upon the condition estimate; and speaker means, connected to the output of the hearing aid processing means, for converting the processed compensated audio signal into a sound signal;

wherein said feedback cancellation means forms a feedback path from the output of the hearing aid processing means to the input of the subtracting means and includes:

a reference filter, and a current filter, wherein the reference filter varies only when the control signal indicates that the audio signal is suitable for estimating physical feedback, and wherein the current filter varies at least when the control signal indicates that the signal is not suitable for estimating physical feedback.

12. The hearing aid of claim 11 wherein the current filter varies more frequently than the reference filter.

13. The hearing aid of claim 12 wherein the current filter represents the current best estimate of physical feedback; wherein the feedback signal is filtered through the current filter; and wherein the current filter is constrained by the reference filter.

14. The hearing aid of claim 12 wherein the current filter varies continuously.

15. The hearing aid of claim 11 wherein the current filter represents a deviation applied to the reference filter; and wherein the feedback signal is filtered through the current filter and the reference filter.

16. The hearing aid of claim 11 wherein the means for estimating the condition of the audio signal comprises means for detecting whether the signal is broadband, and the reference filter varies only when the control signal indicates that the signal is broadband.

17. The hearing aid of claim 16, wherein the hearing aid processing means comprises means for computing the signal spectrum of the audio signal; wherein the means for estimating computes the ratio of the maximum to minimum input power spectral density and generates a control signal based upon the ratio; and wherein the control signal indicates the audio signal is suitable when the ratio exceeds a predetermined threshold.

18. The hearing aid of claim 16, wherein the hearing aid processing means comprises means for computing the correlation matrix of the audio signal; wherein the means for estimating computes the condition number of the correlation matrix and generates a control signal based upon the condition number; and wherein the control signal indicates the audio signal is suitable when the condition number falls below a predetermined threshold.

19. The hearing aid of claim 11, further comprising:

monitoring means for monitoring the reference filter to detect significant changes in the feedback path of the audio system.

20. The hearing aid of claim 11, further comprising:

constraining means for preventing the current filter from deviating excessively from the reference filter.

* * * * *